United States Patent [19]

Canale et al.

[11] 4,374,036

[45] Feb. 15, 1983

[54] COMPOSITION AND CONCENTRATE USEFUL FOR MAKING A FOUNTAIN SOLUTION FOR LITHOGRAPHIC PRINTING OPERATIONS

[75] Inventors: Ralph D. Canale, Long Island City; Albert S. Canale, Massapequa; Harry Papazian, Long Island City, all of N.Y.

[73] Assignee: Michael A. Canale, Long Island City, N.Y. ; by said Harry Papazian

[21] Appl. No.: 208,253

[22] Filed: Nov. 19, 1980

Related U.S. Application Data

[63] Continuation-in-part of Ser. No. 140,689, Apr. 16, 1980, Pat. No. 4,340,509.

[51] Int. Cl.[3] ..... B41L 25/00; B41M 1/06; C11D 3/075; C11D 3/43

[52] U.S. Cl. ..... 252/135; 101/424; 101/451; 252/139; 252/173; 252/174.15; 252/174.16; 252/174.21; 252/174.23; 252/DIG. 14; 252/527; 430/309

[58] Field of Search ..... 252/135, 139, 174.16, 252/174.15, 174.21, 174.23, 527, 173; 101/424, 451; 430/309

[56] References Cited

U.S. PATENT DOCUMENTS

| | | | |
|---|---|---|---|
| 3,312,624 | 4/1967 | Dupre et al. . | |
| 3,429,822 | 2/1969 | Grunewald et al. . | |
| 3,720,621 | 3/1973 | Smeets . | |
| 3,843,558 | 10/1974 | Farminer et al. . | |
| 3,933,672 | 1/1976 | Bartolotta et al. . | |
| 4,005,030 | 1/1977 | Heckert et al. . | |
| 4,007,124 | 2/1977 | Collier et al. . | |
| 4,242,217 | 12/1980 | Westermann et al. | 252/139 X |

*Primary Examiner*—Dennis L. Albrecht

*Attorney, Agent, or Firm*—Curtis, Morris & Safford

[57] ABSTRACT

A composition suitable for production of a fountain solution for lithographic printing operations, which comprises tetrapotassium pyrophosphate, monosodium phosphate, a sequestrant, a water-soluble polyethylene glycol, sodium carboxymethyl cellulose, a low- or non-foaming nonionic detergent, an anionic detergent and a polysiloxane. The invention is also directed to a concentrate and a fountain solution, both of which comprise a mixture of water and the foregoing composition.

18 Claims, No Drawings

COMPOSITION AND CONCENTRATE USEFUL FOR MAKING A FOUNTAIN SOLUTION FOR LITHOGRAPHIC PRINTING OPERATIONS

This application is a continuation-in-part of U.S. application Ser. No. 140,689, filed Apr. 16, 1980, the subject matter of which is incorporated herein by reference.

The invention disclosed in said U.S. Pat. No. 4,234,443 relates to a composition adapted for use in a fountain solution. The composition consists essentially of 2 to 66% by weight trisodium phosphate; 0.5 to 26.0% by weight sodium metasilicate; 2 to 67% by weight tetrapotassium pyrophosphate; 2 to 25% by weight of a nonionic detergent selected from the group consisting of condensation products of ethylene oxide with dialkyl phenols, the dialkyl moieties of which are of from 2 to 20 carbon atoms, and condensation products of ethylene oxide with monohydric hydrocarbon alcohols of from 12 to 20 carbon atoms, the molar ratio of ehtylene oxide units to each dialkyl phenol unit or monohydric hydrocarbon alcohol unit in each said condensation product being of from 0:1 to 150:1; and 0.02 to 10.00% by weight dialkylpolysiloxane. The invention also relates to a concentrate and fountain solution both consisting essentially of water and said composition.

The invention disclosed in said application Ser. No. 140,689 relates to a composition suitable for use in a fountain solution. The composition comprises 2 to 66% by weight trisodium phosphate, 0.5 to 26.0% by weight sodium metasilicate, 2 to 67% by weight tetrapotassium pyrophosphate, 2 to 25% by weight of a nonionic detergent which is a condensation product of ethylene oxide with an alkylamine, and 0.02 to 10% by weight dialkylpolysiloxane. The invention additionally relates to a concentrate and fountain solution, both of which comprise water and said composition.

The subject matter of U.S. Pat. No. 4,234,443, granted Nov. 18, 1980 to Ralph D. Canale et al. is also incorporated herein by reference.

The inventions of said application Ser. Nos. 890,018 and 140,689 provide alternatives to the use of fountain solutions containing gum arabic, bichromates and phosphoric acid, and to the use of alcohol systems in lithography.

FIELD OF THE INVENTION

The present invention relates to a composition suitable for making a fountain solution for use in lithographic printing operations. The invention also relates to a concentrate which comprises water and the aforementioned composition. Additionally, the invention relates to a fountain solution, comprising water and said composition, which fountain solution is made up from said composition or said concentrate with water.

DESCRIPTION OF THE PRIOR ART

In lithographic printing operations, such as lithographic printing of newspapers, brochures and the like, fountain solutions are brought into contact with lithographic plates to maintain the non-printing surfaces of such plates water-receptive, or hydrophilic, to clean the surfaces of the plates and to replenish desensitized portions of the plates.

Prior to the present invention, there were formulated acid-based fountain solutions which contained pure gum arabic, bichromates and phosphoric acid. These acidified gum solutions were used in the formulation of desensitizers or etchants for use in stone lithography, zinc plate lithography, and photolithography, on both zinc and aluminum. With the introduction of rotary lithographic sheet-fed presses, which afford a capability of supplying ink and water continuously to the surface of a lithographic plate, came the development of acidified gum solutions adapted for continuous replenishment of the desensitized area of a lithographic plate. Thus, lithography could be carried out without interruption.

However, use of such acidified gum solutions involves drawbacks. The component bichromates, while forming with gum arabic and phosphoric acid effective desensitizers, can be absorbed and retained in the human body to produce serious rashes. In addition, acidified gum fountain solutions are, generally, made up at the lithographic printing site; hence, the possibility of error in formulation, or nonuniformity, which would affect the lithographic printing process is increased.

Furthermore, these acidified gum solutions have a tendency to reduce the brightness of ink printed on a substrate, along with retarding the drying of the ink film on the substrate, which is a severe drawback in high speed printing. Also, acidic gum solutions can cause rollers of a lithograhic printing apparatus to glaze, and eventually strip, thereby creating ink-distribution problems. Blankets can become glazed and tacky to cause poor transfer, lift and trapping. Such conditions necessitate frequent and prolonged maintenance work on a lithographic press, and result in costly down-time of the press. And due to the acid content of these prior solutions background water-receptive surfaces frequently become sensitive and oxidation-prone, thereby necessitating immediate gumming to protect and revitalize these surfaces during down-time.

Another drawback attending use of acidified gum solutions resides in the fact that presence of gum in large amounts promotes the growth of algae and fungus mold which tend to accumulate in pans and feed lines of a lithograhic press system, and impede its operation. Substitute formulations not containing bichromates have been used. But, since these formulations still contain acids, chrome alums and various gums, they suffer from many of the same deficiencies as the above-discussed acidified gum solutions. For example, acid content of a substitute formulation causes background, water-receptive surfaces to become sensitive and oxidation-prone, thereby necessitating immediate gumming during down-time of the lithographic press. Additionally, since with these substitute formulations acids are used in high concentrations to get maximum effects, operation at a pH of 3 to 4 is not unusual. However, high acidic concentration contributes greatly to image deterioration and ink-receptiveness of background areas which are intended to be hydrophilic; this causes scumming.

To alleviate some of these problems, alcohol solutions, such as solutions containing isopropyl alcohol, have been employed in lithographic operations, for example, in printing plants incorporating a fountain solution circulating and dispensing system, called a Dahlgren system. However, with such alcohol solutions there is a tendency for the gum to separate from the fountain water. Further, use of these alcohol solutions frequently results in loss of print quality; heavier ink deposition is often used to compensate, and this requires use of a commensurately larger amount of water, thereby presenting an additional problem.

More recently, alkali fountain solutions have been developed and have found wide commercial applicability for use in modern high-speed newspaper web offset presses. Alkali fountain solutions lend themselves well to use in such presses since the solutions do not contain, and their operation is not dependent on the presence of, gum arabic or synthetic gums as desensitizers. These gums have a tendency, in high-speed operations, to accumulate on blankets and ink rollers of a press and create a glaze tending to cause ink to strip from the ink rollers; elimination of these gums removes this difficulty. Also, with alkali fountain solutions the need to gum the surfaces of lithographic plates during down-time is obviated, since the plates have not been exposed to acidic conditions.

However, even alkali fountain solutions interfere with the transference of the true quality (for example brightness) of ink to the paper on which an image is being printed. To compensate for this it has been found necessary to operate with increased amounts of ink and, therefore, increased amounts of water, both of which cause evident processing disadvantages.

OBJECTS OF THE INVENTION

It is an object of this invention to provide a neutral (i.e., neither acidic nor alkaline) fountain solution, and a composition which when mixed with a predetermined amount of water yields such fountain solution.

It is also an object of this invention to provide an effective composition suitable for making a lithographic fountain solution, which composition can be readily and conveniently packaged and shipped in an efficient and economical manner.

It is an additional object of this invention to provide a concentrate which, when mixed with water, yields a neutral fountain solution.

It is a further object of this invention to provide a neutral fountain solution which cleans, and replenishes the hydrophilicity of, background non-image surfaces of lithographic plates to maintain such plates uninterruptedly in a condition which yields clean images.

It is another object of this invention to provide a neutral fountain solution which eliminates the need to gum non-image surfaces of lithographic plates repeatedly, and allows the true quality of ink to be transferred, thereby reducing the amounts of ink and water necessary for printing.

It is yet another object of the invention to provide a neutral fountain solution which is compatible with lithographic press apparatus equipped with an alcohol system, and which affords the capability of printing with an alcohol content of less than 5%.

It is still another object of this invention to provide a neutral fountain solution which maintains clean, and free of fungus mold and algae, the entire fountain system.

Yet another object of this invention is to provide a composition which, when mixed with a predetermined quantity of water, forms a lithographic fountain solution which avoids other drawbacks of prior fountain solutions.

These and other objects and advantages of the present invention will become more readily apparent after consideration of the following.

STATEMENT AND ADVANTAGES OF THE INVENTION

The invention is directed to a composition, which comprises 15 to 40% by weight tetrapotassium pyrophosphate; 15 to 40% by weight monosodium phosphate; 1 to 15% by weight of a sequestrant; 0.5 to 6% by weight of a water-soluble polyethylene glycol; 0.5 to 4% by weight sodium carboxymethyl cellulose; 1.9 to 6% by weight of a low- or non-foaming nonionic detergent; 0.25 to 5% by weight of an anionic detergent which is selected from the group consisting of alkyl orthophosphates and salts thereof, and alkyl polyphosphates and salts thereof; and 0.15 to 2.7% by weight of a polysiloxane. The invention is also directed to a concentrate and a fountain solution, both of which comprise a mixture of water and the foregoing composition.

Numerous advantages accrue with the practice of the present invention.

The composition of the present invention is advantageous in that it is a mixture suitable for shipping in bulk to the site of lithographic printing operations. At this site, the composition, when mixed with water, produces an effective neutral fountain solution for lithographic printing operations. A given amount of the composition of this invention can be mixed with a predetermined amount of water to form a fountain solution, thereby reducing the possibility of error and nonuniformity in formulation.

The fountain solution produced with the composition of this invention is neither acidic nor alkali. The constituents of the composition are particularly well-suited for the maintenance of neutral pH and fountain solution stability with a reduced overall "salt" content and solution density. Therefore, problems encountered with prior solutions containing acid components are significantly diminished or altogether avoided.

The fountain solution of the present invention, therefore, is capable of continously replenishing the hydrophilicity of background, non-image areas of lithograhic plates because its chemical components are chemically similar to those of the original surface structure of the plate and are intensely hydrophilic. Ink returning to the fountain solution pan is dissipated by the detergent components of said fountain solution, and does not return via the fountain rollers to the lithographic plate. Significantly, the present invention affords these advantages without the accompanying disadvantages of prior fountain solutions. Further oxidation of non-image areas of lithographic plates due to exposure to acid is eliminated, as are image deterioration and scumming of hydrophilic background areas brought about by high acid concentration of the fountain solution. Since there is no oxidation, there is correspondingly no need for gumming of the plate no matter how long it stands exposed during down-time. Additionally, slow drying of ink film, which is characteristic of lithographic operations involving acidified gum fountain solutions and is a severe drawback in high-speed newspaper web offset printing, is obviated. And, glazing and eventual stripping of ink rollers, creating ink-distribution problems, and glazing and tackiness of blankets, causing poor transfer, lift and trapping and resulting in frequent and prolonged maintenance and costly down-time, due to the use of acidified gum fountain solutions are avoided.

Furthermore, since the fountain solution of the present invention does not contain bichromates, their detrimental effects upon personnel involved in lithographic operations are eliminated.

Since the fountain solution of the present invention is neither acidic nor alkali, transference of true brightness of ink color to paper is realized; there is no need to employ increased amounts of ink, and water, in order to attain an acceptable level of image brightness. Moreover, the necessity of using large amounts of alcohol to offset slow drying of ink film with use of an acidified gum solution is eliminated, since the fountain solution of the present invention is suitable for printing with as low as a 5% by weight alcohol solution, as opposed to prior 20 to 30% by weight alcohol solutions in current use. Thus, deterioration of print quality and heavier ink deposition which attend use of said prior alcohol solutions are eliminated.

In addition, with the fountain solution of this invention, it is possible to maintain clean the entire water fountain system, pans, brushes, pumps and tanks of a lithographic press. Also, with the fountain solution of this invention algae build-up and fungus mold formation in pans and feed lines of the fountain system are greatly reduced. Thus, the dampening train of the rollers of a lithographic press deposits a clean film of fountain water on the surface of a lithographic plate.

DESCRIPTION OF PREFERRED EMBODIMENTS

The composition of this invention is advantageously in the form of a free-flowing dry powder. This promotes convenient handling of the composition, especially upon combination with water to form a fountain solution; the composition dissolves more quickly when in powder form than in larger particle or granule sizes. However, while the most preferred embodiment of the composition of this invention is as a dry powder, the characteristics of a fountain solution formed from said composition in alternative forms of larger particles or granules, or in the form of a paste, or the like, are not diminished. Thus, a composition in any of the above-mentioned alternative forms is also within the scope of the invention.

Although not essential, it is advantageous that tetrapotassium pyrophosphate ($K_4P_2O_7$) and monosodium phosphate constituents by anhydrous.

In a preferred embodiment of the present invention, a dry powder mixture is formulated containing anhydrous tetrapotassium pyrophosphate and anhydrous monosodium phosphate. The anhydrous nature of these salts promotes free flowability of the composition even after long periods of storage and leads to realization of an above-mentioned object of the invention, i.e., provision of an effective composition suitable for making a lithographic fountain solution, which composition is readily and conveniently packaged and shipped in an efficient and economical manner.

Anhydrous tetrapotassium pyrophosphate typically has a molecular weight of 330.34, a solubility of 191 g./100 g.$H_2O$ at 25° C., 207 g./100 g.$H_2O$ at 50° C. and 247 g./100 g.$H_2O$ at 75° C.; its loose bulk density is 60 lb./ft.$^3$ in powder form and 75 lb./ft.$^3$ is granular form.

Anhydrous monosodium phosphate ($NaH_2PO_4$) typically has a molecular weight of 120.0, a solubility of 65 g/100 g.$H_2O$ at 10° C., 87 g./100 g.$H_2O$ at 25° C. and 146 g./100 g.$H_2O$ at 50° C.; its bulk density is 58 lb./ft.$^3$ in granular form. Typically, a 1% solution has a pH of 4.6; the granular anhydrous compound contains 0.1% moisture and has an absorbency of about 14%. Anhydrous monosodium phosphate also typically contains 0.8% pyrophosphate, 0.01% of insolubles and 59.0% of $P_2O_5$. A typical screen analysis is as follows:

Thru U.S. 14 . . . 99%

Thru U.S. 100 . . . 13%

It will be understood that the incorporation of tetrapotassium pyrophosphate in the composition for forming a fountain solution for lithographic printing substantially improves the overall performance, for instance, as relating to sequestration, deflocculation (peptizing), emulsification, buffering and saponification of the fountain solution of this invention compared to performance when such compound is eliminated, or present only in traces. Thus, its incorporation in the composition promotes attainment of the stated utility of the invention.

Since water is an important constituent of a fountain solution in accordance with this invention, this water is desirably as free as possible of interfering agents, particularly undesirable metal ions, in local water supplies. These interfering agents, especially the metal ions, such as calcium and magnesium, tend to react with various constituents of the fountain solution ink, and the like, to cause deposition of scale and sludge in the lithographic press system. Incorporation in the composition, concentrate and fountain solution of this invention of a sequestrant or chelating agent, aids in eliminating these interfering agents from water employed in the fountain solution. For example, a suitable sequestrant complexes various interfering ions and holds them in solution, thereby preventing their reaction with other species present and subsequent precipitation. Presence of the sequestrant confers the further advantage that oxide formation on aluminum apparatus surfaces during press shutdown is impeded.

The sequestrant is, typically, a compound which combines with the above-mentioned interfering ions to prevent their reaction with other substances present; the sequestrant is also suitably a combination of such compounds, particularly the sodium salts, of ethylenediaminetetraacetic acid (EDTA), diethylenetriaminepentaacetic acid (DTPA), N-hydroxyethylethylenediaminetriacetic acid (HEDTA) and nitrilotriacetic acid (NTA), as well as mixtures of these salts. These salts of polyaminocarboxylic acid are variously available commercially under the following names: CHEELOX BF-76, CHEELOX BF-79, CHEELOX HE-24 and CHEELOX NTS-Na3, all from GAF Corporation; CHELON EDTA from Cowles; HAMPENE 215, HAMPENE Na4, HAMPENE Na2, all from Hampshire, KALEX 100 from Hart Products, PERMA KLEER 80, PERMA KLEER DiCRYSTAL, PERMA KLEER TETRA CRYSTAL and PERMA KLEER TRICRYSTAL, all from Millmaster Onyx Group of Kewanee Industries Ltd.; SEQUESTRENE Na2, SEQUESTRENE Na3T, SEQUESTRENE Na4 and SEQUESTRENE ST, all from Ciba-Geigy Corp.; TETRINE from Glyco Chemicals, Inc. and VERSENE POWDER, VERSENE 220, VERSENE NTA and VERSENE Na2 POWDER, all from Dow Chemical Chemical Company. Other suitable sequestrants, or chelating agents, are citric acid, gluconic acid and sodium gluconate.

Another constituent of the composition of this invention is sodium carboxymethyl cellulose, a semi-synthetic, water-soluble polymer having a molecular weight of up to approximately 500,000. The polymer is characterized by substitution of $CH_2COO^-Na^+$ on the cellulose chain through an ether linkage, and is a sodium salt of a carboxylic acid due to its preparation in an alkaline medium. Illustratively, a method for such preparation comprises impregnating cellulose with caustic soda (NaOH) and reacting same with sodium monochloroacetate. Sodium carboxymethyl cellulose is typically colorless, odorless and nontoxic, the pH of a 1% solution of same being about 6.5 to 8.0. Also typically, sodium carboxymethyl cellulose is stable in a pH range of from 2 to 10; has a specific gravity of about 1.59; has a refractive index of about 1.5; has a tensile strength of about 8,000 to 15,000 psi, has a viscosity in 1% solution of from 5 to 2000 centipoises (depending on the extent of etherification); is insoluble in organic liquids, and reacts with heavy-metal salts to form films that are insoluble in water, transparent, relatively tough, and unaffected by organic materials. Sodium carboxymethyl cellulose, for example, comprises units of the following formula:

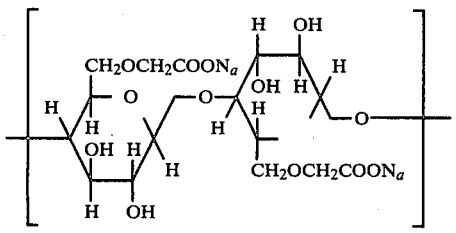

The above-mentioned polymer is available commercially from Hercules, Inc. under the name Sodium Carboxymethyl Cellulose, Type 12M31, from American Hoechst Corporation under the name Tylose MH6000K and from Dow Chemical Corp. under the name Methocel 4000.

A water-soluble polyethyleneglycol is advantageously incorporated in the composition of the present invention. Such polyethyleneglycol is suitably a waxy solid, and in some embodiments is in the form of flakes. Typically, the polyethyleneglycol has a structural formula as follows:

$$HO—CH_2CH_2—O(CH_2CH_2O)_n—H$$

wherein n is about 90. Thus, the polyethyleneglycol suitably has an average molecular weight of, say, from 3350 to 4000. A commercially available product comprising such polyethyleneglycol is produced by Union Carbide Corp. and designated CARBOWAX 3350. Lower molecular weight ethyleneglycol polymers are liquid in form, and are not as advantageous as the previously described polyethyleneglycol to the extent that they frequently cause the composition of the present invention to be soggy or pasty. However, they are nonetheless suitable for practicing the present invention. The above-mentioned polyethyleneglycols impart increased solvency, anti-linting properties, increased lubricity and lower surface tension to fountain solutions made with the composition of this invention. Also, these fountain solutions exhibit an enhanced ability to level inks used in the lithographic processes in which the fountain solution of this invention is employed. It will be understood that polyethyleneglycols which are not soluble in water, and typically have a molecular weight which is appreciably higher than 4000, do not impart the above-discussed desired properties to the fountain solution.

The nonionic detergent is either one or more nonionic detergent compounds. However, not all nonionic detergent compounds are suitable for incorporation in the composition of this invention. More specifically, suitable nonionic detergent compounds are those which exhibit strong hydrophilicity and low- or non-foaming tendencies (in water), or, at most, a very rapid foam break to minimize any foam build-up. Such compounds are available commercially, and any of these is employable in various embodiments of the invention.

In connection with the foregoing, it will be understood that the most strongly hydrophilic moieties in nonionic detergents are ether linkages (—O—) and hydroxyl groups (—OH). Additional moieties contributing to hydrophilicity are ester $$(—O—\overset{\overset{\displaystyle O}{\|}}{C}—)$$

and amide $$(—N—\overset{\overset{\displaystyle O}{\|}}{C}—)$$

linkages. Since the contribution (to hydrophilicity) of an individual oxygen is relatively weak, nonionic detergent compounds effective in the practice of the present invention suitably contain a multiplicity of oxygens to achieve high water-solubility. In advantageous embodiments, such water-solubility is achieved with a nonionic detergent compound wherein the polyoxyethylene content is of from about 50 to 75% by weight of a molecule of the compound. Thus, unmodified polyol nonionic detergent compounds, which (although conventionally used as coemulsifiers) exhibit dominant lipophilic properties, are not suitable for employment in this invention.

Suitable nonionic detergent compounds are:

ethoxylated alkylphenols, the alkyl of which is of from 8 to 12 carbon atoms, and in which the polyoxyethylene moiety is of from about 50 to 75% of the total molecular weight; illustrative is a compound of the formula

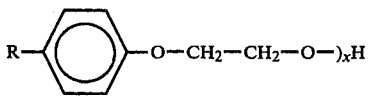

wherein R is alkyl of from 8 to 12 carbon atoms and x is a number of from 5 to 12, such as a compound wherein R is 10 and x is 10;

ethoxylated aliphatic alcohols, wherein the alkyl is generally up to 20 carbon atoms, preferably of from 12 to 20 carbon atoms, and advantageously of straight-chain configuration; the molar ratio of hydrophobic unit(s) to ethylene oxide units is of from 1:1 to 1:150, preferably 1:5 to 1:150; illustrative is a compound of the formula $$R—O—(CH_2—CH_2—O—)_xH$$

wherein R is of from 12 to 20 carbon atoms and x is a number of from 1 to 150, such as a compound wherein R is 12 and x is 10;

(lower) alkoxylated fatty acids, such as ethoxylated fatty acids, the molar ratio of ethylene oxide units to fatty acid unit(s) being of from 12:1 to 15:1; an example is a compound of the formula $$R—C—O—(CH_2—CH_2—O—)_xH$$

wherein R is alkyl of from 12 to 18 carbon atoms and x is a number of from 12 to 15, such as a compound wherein R is 12 and x is 12;

ethoxylated propylene oxide-propylene glycol condensates, especially those which are water-miscible solids; illustrative is a copolymer of the formula $$HO(—CH_2CH_2CH_2—O—)_x(—CH_2CH_2CH_2—O—)_y(—CH_2CH_2—O—)_zH$$

wherein x, y and z are the same or not the same and each is an integer, such that substitution for x, y and z in the above formula gives a high molecular weight compound, such as a copolymer wherein x is 30, y is 32 and z is 28.

As previously mentioned, many of the foregoing nonionic detergent compounds are available commercially. Thus, products comprising ethoxylated alkylphenols are designated Igepals (from GAF Corporation), Neutronyx (from the Millmaster Onyx Group of Kewanee Industries, Ltd.), Poly Tergents (from Olin Corp.), Renex (from Imperial Chemical Industries, Ltd.), Sterox (from Monsanto Chemical Co.), Surfonics (from Jefferson Chemical Company), Tergitol (from Union Carbide Corp.) and Triton (from Rohm & Haas Company). Products comprising ethoxylated aliphatic alcohols are designated Alfonic Ethoxylates (from Continental), BRIJ (from Imperial Chemical Industries, Ltd.), Lipals (from Drew Chemical Corp.), Neodals (from Shell Oil Co.), Plurafacs (from BASF Wyandotte Corporation), Poly Tergents (from Olin Corp.), Siponics (from Alcolac, Inc.), Surfonics (from Jefferson Chemical Company), Tergitols (from Union Carbide Corp.) and Trycols (from Trylon). Products comprising ethoxylated fatty acids are designated Renex (from Imperial Chemical Industries, Ltd.), Aldosperse (from Glyco Chemicals, Inc.), Arosurf (from Ashland Oil Co.) and Lipals (from Drew Chemical Corp.). Products comprising ethoxylated propylene oxide-propylene glycol condensates are designated Pluronics (from BASF Wyandotte Corporation).

Incorporation in the composition of an anionic detergent which is suitably either one anionic detergent compound or a mixture of different anionic detergent compounds, each said compound being a phosphate ester or salt thereof, is a key feature of this invention because it confers several highly advantageous properties on a fountain solution made from the composition. Thus, in the fountain solution the anionic detergent functions as an excellent hydrotrope for other nonionic and anionic surfactants; that is, it effectively solubilizes these surfactants to stay in solution in greater amounts than if such detergent were not present. Incorporation of an anionic detergent lowers the cloud point temperature of the nonionic detergent component of such fountain solution, thereby aiding in the retention of the nonionic detergent in the fountain solution even at lower temperatures. In various embodiments of this invention wherein high nonionic and/or anionic surfactant content in the solution is advantageous to confer desired surface active, wetting, emulsifying and detergent properties, the advantages accruing are evident. Furthermore, the presence of an anionic detergent aids, synergistically, in degreasing the lithographic plate; that is to say, the presence of the detergent enhances the detergency of the nonionic detergent component, yielding high soil removal capacity and increasing grease-removing capability. Additionally, this anionic detergent is advantageous in that it is stable in the presence of both acid and alkaline agents, so that presence of such agents will not affect its performance. This imparts a high degree of versatility to a fountain solution containing this anionic detergent in accordance with this invention, rendering it adaptable to employment under widely ranging conditions. Also, such anionic detergent exhibits, in and of itself, excellent wetting and surface active properties. Therefore, its presence enhances the wetting and surface penetration characteristics of a fountain solution in which it is contained.

The above-mentioned anionic detergent is also a dedusting agent, thereby aiding in suppressing the amount of dust raised during combination of the various components of the composition of this invention.

It is preferable to employ the salt form of a phosphate ester rather than the free acid form; however, incorporation of the free acid form is within the scope of this invention. Typically, the phosphate ester compounds which are salts contain an alkali metal cation, such as potassium or sodium; but, other cations, such as alkaline earth metals, metals, ammonium and organic amines are suitably employed in some embodiments.

Accordingly alkyl orthophosphates and salts thereof are suitable anionic detergent compounds, as are alkyl polyphosphates and salts thereof. An example of such alkyl orthophosphate is di(2-ethylhexyl) phosphate and an example of a salt of such polyphosphate is $(2\text{-ethylhexyl})_5Na_5(P_3O_{10})_{12}$.

In general, phosphate esters occur in highly complex mixtures which are not susceptible of description by one formula. For example, a mole of lauryl tri(ethyleneoxy)ethanol phosphorylated with a third of a mole of $P_2O_5$, and then neutralized, would yield a mono ester (the major fraction)

$$C_{12}H_{25}(OC_2H_4)_4OPO_3HM,$$

and di ester (a large fraction)

$$[C_{12}H_{25}(OC_2H_4)_4]_2PO_2M,$$

in both of which M is sodium or potassium, a tri ester (a minor fraction)

$$[C_{12}H_{25}(OC_2H_4)_4]_3PO,$$

a miscellaneous ester (a minor fraction)

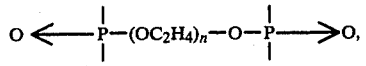

a miscellaneous ester (a minor fraction)

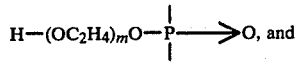

a salt (trace)

$NaH_2PO_3$.

And, even in the foregoing mixture, the polyethoxy unit of the monoester (4) is an average of the actual distribution of all the integral values ranging from 0 to 10, and the lauryl group, $C_{12}H_{25}$, is an average of alkyl moieties ranging from 10 to 14 carbon atoms.

Thus, suitable anionic detergents are reaction products of a nonionic surface active agent with a molar excess of polyphosphoric acid. Such reaction products are well known in the art and set forth in further detail in U.S. Pat. No. 3,235,627, granted Feb. 15, 1966 to Richard C. Mansfield et al.

Some of the nonionic surface active agents suitable for employment are those of the formula

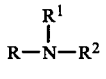

wherein R is $C_8H_{17}$ to $C_{14}H_{29}$, $R^1$ is $(—CH_2—CH_2O)_xH$ and $R^2$ is hydrogen, $C_8H_{17}$ or $(—CH_2—CH_2O)_yH$, x being a number in the range of from 5 to 50 and y being a number in the range of from 5 to 50, provided that the sum of x and y is a number in the range of from 5 to 50;

of the formula

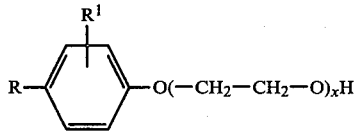

wherein R is hydrogen or alkyl of from 1 to 12 carbon atoms, $R^1$ is hydrogen or alkyl of from 1 to 9 carbon atoms and x is at least 1 and preferably no more than 3;

or of the formula $$R—O—(CH_2—CH_2—O)_xH$$

wherein R is $C_{12}H_{23}$ or $C_8H_{17}$—$C_{18}H_{37}$ and x is at least 1 and preferably no more than 25.

As pointed out in U.S. Pat. No. 3,235,627, numerous other nonionic surface active agents are suitable for production of the above-mentioned reaction products. These nonionics are well known in the art—for instance, see U.S. Pat. No. 3,004,056, granted Oct. 10, 1961 to Leslie G. Nunn, Jr., et al. Such nonionics are suitably obtained by condensing a polyglycol ether containing the requisite number of alkenoxy groups or an alkylene oxide such as propylene oxide, butylene oxide, or (preferably) ethylene oxide, with an organic compound containing a reactive hydrogen atom, such as an alcohol, phenol, thiol, primary or secondary amine, or a carboxylic or sulfonic acid or amide thereof. The amount of alkylene oxide or equivalent condensed with the reactive hydrogen-containing compound, i.e., the length of the polyoxy alkylene chain, will depend primarily upon the particular compound with which it is condensed. As a convenient rule of thumb, an amount of alkylene oxide or equivalent should be employed which will result in a condensation product containing about 20 to 85% by weight of combined alkylene oxide. In any event, the optimum amount of alkylene oxide for attainment of the desired hydrophobic-hydrophilic balance is readily determined by preliminary test and routine experimentation. Some specific examples of nonionic surface active agents suitable for reaction with polyphosphoric acid to form the above-discussed reaction products are those given by reaction of: 1 mole of nonylphenol with 9 to 11 moles of ethylene oxide, 1 mole of dodecylphenol with 18 moles of ethylene oxide, 1 mole of coconut fatty acid amine with 7 moles of ethylene oxide and 1 mole of polypropylene glycol (30 oxy propylene units) with 10 moles of ethylene oxide.

Polyphosphoric acid suitable for reaction with a nonionic surface active agent is a complex mixture of acids, advantageously having a phosphoric acid anhydride content of from about 73 to 85%, expressed as percent $P_2O_5$. The amount of polyphosphoric acid advantageously used for each equivalent of hydroxyl group in the nonionic surface active agent is about 0.6 to about 2.0 moles when a preferred phosphoric acid anhydride content of 82 to 84% is present in the polyphosphoric acid. Illustratively, to a stirred mixture of 312 parts (0.500 m) of "Triton x-100" (an ethylene oxide adduct of p-t-octylphenol having a hydroxyl number of 89.9, which corresponds to an equivalent weight of 624) and 0.55 part of 30% $H_2O_2$ in a nitrogen atmosphere is added 111 parts (0.657 m) of Victor 115% ortho equivalent (82–84% $P_2O_5$) polyphosphoric acid during one-half hour while the temperature rose to 50° C. The mixture is then heated to 105° C. during another $1\frac{1}{2}$ hours and stirred at 105° to 110° C. for $1\frac{1}{2}$ hours. The reaction is complete, as evidenced by no further change in cloud point (73° C./18% NaOH) during another one-half hour. The product is cooled and bottled and has a VCS color of 5.

The above-mentioned phosphorylated reaction products are preferably used in the form of partially or completely neutralized salts containing as cations alkali metals, alkaline earth metals, metals, ammonium and organic amines. Suitable cations are sodium, potassium, lithium, calcium, strontium, barium, magnesium, iron, tin, cadmium, aluminum, antimony, chromium, manganese, mercury, nickel, silver, zinc, ammonium, and aliphatic, alicyclic, aromatic and heterocyclic organic amines such as the mono-, di- and trimethylamines, ethylamines, propylamines, laurylamines, stearylamines, ethanolamines, propanolamines, butanolamines, hexanolamines, cyclohexylamines, phenylamines, pyridylamines, morpholinylamines and the like.

Other suitable anionic detergents are reaction products of $P_2O_5$ with nonionic surface active agents each of which is a condensation product of at least one mole of ethylene oxide, and up to an amount sufficient to provide said agent with about 95% by weight of combined ethylene oxide, with one mole of a compound containing about 6 to about 150 carbon atoms and at least one reactive hydrogen atom in a ratio of one mole of $P_2O_5$ for each 2 to 4.5 hydroxy groups in said nonionic agent, and an amount of an alkaline reacting inorganic alkali metal substance sufficient to yield with said reaction product an aqueous solution having a pH of more than about 12 when the combined concentration of said reaction product and said alkali metal substance in the solution is about 0.3% by weight. Such reaction products are described, for instance, in U.S. Pat. No. 3,168,478, granted Feb. 2, 1965 to Andrew Stefcik et al.

As the alkaline reacting substance, the alkali metal (sodium, potassium) hydroxides and silicates are preferred although other alkali metal (e.g., sodium or potassium) salts may be employed such as the phosphates, carbonates, borates, and the like. Instead of, or in addition to, these strong alkali metal salts there may also be employed relatively weaker salts such as the sodium or potassium polyphosphates, sulfides, cyanides, acetates and the like, the basic requirement being the alkali metal substance, whether a single compound or a mixture of compounds, be employed in an amount sufficient to supply a concentration of alkali metal ion effective to yield a pH of more than about 12 when the compositions of this invention are dissolved in aqueous solution in a concentration of 0.3%. Specific examples of inorganic alkali metal substances are sodium and potassium hydroxide, phosphate, carbonate, sesquicarbonate, bicarbonate, tetraborate, perborate, sulfide, cyanide, acetate, orthosilicate, metasilicate, polyphosphates, and the like. Preferred alkali metal silicates have a mole ratio of $M_2O:SiO_2$ of at least about 0.7:1 and up to 2:1 or the like, where M means Na or K. The alkali metal polyphosphates are well known in the art and may also be referred to as condensed phosphates or molecularly dehydrated phosphates. In general, they have an analytical ratio of alkali metal oxide to $P_2O_5$ of less than 3:1, such ratio usually fall within the range of about 1:2 to 5:3. These polyphosphates are available as alkali metal pyrophosphates, metaphosphates, and polyphosphates in monomeric or polymeric form such as triphosphates, tetraphosphates, hexametaphosphates, decaphosphates, and the like. Examples are tetrasodium and tetrapotassium pyrophosphates, sodium and potassium tripolyphosphates, tetraphosphates, pentaphosphates, hexametaphosphates and mixtures of two or more thereof and the like.

The above-mentioned reaction product of $P_2O_5$ with nonionic surface active agents are suitably prepared by the process described and claimed in previously mentioned U.S. Pat. Nos. 3,004,056 and 3,004,057, the latter granted Oct. 10, 1961 to Leslie G. Nunn, Jr.

Although the exact chemical constitution of the reaction products is not definitely known (due to the recognized tendency of the $P_2O_5$ to form complex products and polymers), such reaction products, in general, contain about 20 to 45% of the secondary phosphate ester of the nonionic agent, 30 to 80% of the primary phosphate ester, 0 to 40% of unreacted nonionic agent, and small amounts of unidentified by-products.

Suitable nonionic surface active agents are well known in the art. In general, they are obtainable by condensing a polyglycol ether containing the required number of alkenoxy groups or an alkylene oxide such as propylene oxide, butylene oxide, or preferably ethylene oxide, or mixtures thereof, with an organic compound containing at least 6 carbon atoms and a reactive hydrogen atom. Illustrative of compounds containing a reactive hydrogen atom are alcohols, phenols, thiols, primary and secondary amines, and carboxylic and sulfonic acids and their amides. Such compounds containing more than one reactive hydrogen atom, i.e., more than one hydroxy, mercapto, amino, amido, carboxylic, sulfonic or sulfonamido group, each such group in the compound being reactive with the alkylene oxide in suitable proportions, are also suitable. The amount of alkylene oxide or equivalent condensed with the reactive hydrogen-containing compound, i.e., the length of the polyoxy alkylene chain, will depend primarily on the particular compound with which it is condensed. Illustratively, an amount of alkylene oxide or equivalent should be employed which will result in a condensation product containing about 20 to 95% by weight of combined alkylene oxide; in any event, the optimum amount of alkylene oxide for attainment of desired hydrophobic-hydrophilic balance is suitably determined by preliminary test and routine experimentation.

The reaction between the reactive hydrogen-containing organic compound and the alkylene oxide is substantially quantitative, although it will be understood that the product of this reaction will be a mixture of polyoxy alkylene derivatives of varying oxy alkylene chain length, the average of which substantially corresponds to the amount of alkylene oxide reactant. Such product contains an average of at least one hydroxy group (in a terminal $—C_2H_4OH$ group) per molecule.

Examples of types of organic compounds containing a reactive hydrogen atom are:

aromatic mono- and poly-hydroxy compounds such as phenols, naphthols, benzene and naphthalene diols, triols, and tetrols and the like, such as normal and isomeric mono-, di- and tri-butyl, nono and octadecyl phenols and cresols, and phenols and cresols substituted by a plurality of different alkyl groups of from 4 to 20 carbon atoms each;

straight and branched chain, saturated and unsaturated aliphatic monohydric and polyhydric alcohols of natural or synthetic origin, such as lauryl alcohol, stearyl alcohol, and the like, and diol precursors of the Pluronic type nonionic surface active agents, generally prepared by polyoxy ethylenation of a polymerized alkylene oxide of at least 3 carbon atoms, preferably propylene oxide, to produce the corresponding water-insoluble propylene glycol having a molecular weight of up to about 3000 (or of the reaction product of a plurality of moles of propylene oxide or substituted propylene oxide with alkylene diamines such as ethylene diamine and propylene diamine, polyalkylene polyamines, and alkane diols such as ethanol glycol, hexamethyl glycol and the like), primary aliphatic alcohols containing a plurality of side chains produced, for example, by subjecting an olefin containing at least 7 carbons and at least two side chains (such as tripropylene, tetrapropylene, pentapropylene, diisobutylene, triisobutylene, and the like) to the Oxo process, and straight chain alcohols produced from the Fischer-Tropsch olefins by the Oxo process or those produced by oxidation of Ziegler type polymer intermediates;

higher fatty acids of animal and vegetable origin and mixtures containing same, such as lauric acid, oleic acid, stearic acid, and the animal and vegetable fats and oils containing same, or acids derived by oxidation of suitable petroleum fractions;

aliphatic and aromatic mono- and poly-mercapto compounds including cetyl mercaptan, dodecyl mercaptan, alkylnaphthylamine, alkylthiophenol, thionaphthol and the like;

aliphatic and aromatic mono- and poly-amines, including lauryl amine, stearyl amine, alkylbenzyl amine, alkylnaphthyl amine, dodecylene diamine, tetrapropyl pentamine, and the like;

carboxylic amides such as lauric acid amide, stearic acid amide, and the like; and sulfonamides such as dodecyl sulfonamide, dodecyl benzene sulfonamide, and the like.

Specific examples of nonionic surface active agents suitable for reaction to form the above-mentioned reaction products are condensates of 1 mole of nonylphenol and 9 to 11 moles of ethylene oxide, 1 mole of dodecylphenol and 18 moles of ethylene oxide, 1 mole of lauryl alcohol and 4 moles of ethylene oxide, and 1 mole of decyl sulfonamide and 6 moles of ethylene oxide.

Additionally suitable anionic detergents are mono- and diphosphate esters and mixtures thereof obtained by reacting 1 mole of $P_2O_5$ with 2 to 4.5 moles of a nonionic surface active agent under substantially anhydrous conditions and then hydrolyzing the phosphate ester with at least about 0.15% by weight of water at a temperature below the decomposition temperature of the phosphate ester. Nonionic surface active agents suitable for use in preparing the above-mentioned phosphate esters generally comprise hydroxylic organic compounds containing at least 6 carbon atoms and a reactive hydrogen atom, and preferably the alkylene oxide condensation products of said hydroxylic organic compounds. When alkylene oxide adducts of organic hydroxylic compounds containing at least 6 carbon atoms are employed, these adducts advantageously contain less than about 0.15% by weight of polyglycol by-products having a molecular weight greater than 1000. Salts of such esters, or mixtures thereof, are also suitable. Esters and salts such as these are described in U.S. Pat. No. 3,770,855, granted Nov. 6, 1973 to Albert Benson et al.

The alkylene oxide hydroxylic organic compound condensation products employed as reactants in the present invention are well known in the art. In general, they are obtainable by condensing an alkylene oxide such as propylene oxide, butylene oxide, or preferably ethylene oxide with an organic compound containing at least 6 carbon atoms and a reactive hydrogen atom. Suitable compounds containing a reactive hydrogen atom are straight and branched chain aliphatic alcohols, containing at least 6 carbon atoms, particularly linear and branched chain saturated alcohols containing from 8 to 18 carbon atoms, and phenols, particularly the mono- or di-alkylphenols containing from about 4 to 20 carbon atoms in the alkyl radical. It is advantageous to employ alkylene oxide condensation products in the preparation of the above-mentioned phosphate esters that contain substantially no polyglycol by-products. Especially suitable are alkylene oxide condensation products that contain no more than about 0.5% by weight of polyglycols having a molecular weight greater than 1000.

Non-ethoxylated nonionic surface active agents suitable for use in preparing these phosphate esters are hydroxylic organic compounds containing at least 6 carbon atoms and a reactive hydrogen atom. Suitable compounds are aliphatic alcohols, both straight chain and branched chain, as, for example, 2-ethylhexanol, octanol, decanol, dodecanol and octadecanol; cycloaliphatic alcohols, as, for example, cyclohexanol and cycloheptanol; higher fatty alcohols having at least 8 carbon atoms obtainable from the various fatty acids or glycerides; and multi-branched chain primary alcohols having the molecular configuration of an alcohol, produced by the Oxo process from a polyolefin of at least 7 carbon atoms.

The above-mentioned phosphate esters are suitably phosphorylation products of any one of the nonionic surface active agents hereinabove described, or mixtures thereof.

$P_2O_5$ is the preferred phosphating agent. Thus, 1 mole of $P_2O_5$ is reacted with about 2 to 4.5 moles of a nonionic surface active agent, or mixture of such agents, hereinabove described at a temperature of no higher than about 110° C., and preferably between about 35° and 65° C., under substantially anhydrous conditions. After phosphorylation is complete, at least 0.5% by weight and preferably between 1% and 3% by weight of water based on the weight of the reaction batch is added and hydrolysis is allowed to proceed for a period of time that may range from 1 to 4 hours at ambient temperatures up to about 150° C. and preferably between about 60° C. and 110° C. The reaction batch is then cooled to about 30° C.

The phosphate esters produced are suitably used, not only in the free acid form, but also as partially or completely neutralized salts containing as cations alkali metals, alkaline earth metals, ammonium and organic amines. Any suitable compound containing the desired alkali metal, alkaline earth metal, ammonium or organic amine substituent may be employed to prepare the neutral salt. Illustratively, an aqueous sodium hydroxide solution is particularly advantageous for this purpose inasmuch as water can be readily stripped from the neutralized phosphate ester solution.

Examples of suitable phosphate ester compounds are the product designated GAFAC LO-529, available commercially from GAF Corporation, the product designated ULTRAPHOS 21A, available comercially from Witco Chemical Company, and the product designated TRITON H-55, available commercially from Rohm & Haas Company.

A polysiloxane is included in the composition, concentrate and fountain solution of the present invention to prevent excessive foaming in the ultimately formed fountain solution. It is advantageously incorporated in the composition by spraying a solution or emulsion thereof onto a substantially dry, preferably powder, mixture including tetrapotassium pyrophosphate, monosodium phosphate, nonionic detergent and anionic detergent, but can be added by other means, for example, by gently pouring such solution or emulsion on a mixture of various components of the composition of the invention.

A preferred polysiloxane is dialkylpolysiloxane, especially dialkylpolysiloxane wherein each alkyl moiety is of up to 10 carbon atoms. An example is dimethylpolysiloxane, but other dialkylpolysiloxanes, such as diethylpolysiloxane and dipropylpolysiloxane are also suitable. One commercially available product which is useful in the present invention is ANTIFOAM B EMULSION, available from Dow Corning Corp. This EMULSION typically contains 10% active defoamer, i.e., dimethylpolysiloxane, in the form of a silicon and water emulsion. At 77° F., this emulsion generally has the consistency of a light cream, a specific gravity of 1.003 and a pH of 6.5. Additional examples of products containing dimethylpolysiloxane and suitable for use in this invention are SM-2162, available from General Electric Co., a silicon release agent which contains about 50% active dimethylpolysiloxane solids, is of the nonionic emulsifier type, and exhibits a specific gravity of about 0.989 at 25° C.; and AF-75, also available from General Electric Co., an antifoam emulsion containing about 10% active dimethylpolysiloxane solids, being of the nonionic emulsifier type and having a specific gravity of 1.02 at 25° C.

Other types of polysiloxanes typically suitable for employment in the present invention are:

a polyoxyalkylene-modified dimethylpolysiloxane each alkylene preferably being of up to 20 carbon atoms, for instance, a polyoxyethylene- or polyoxypropylene-modified dimethylpolysiloxane; an example is the product designated L-70 available commercially from Union Carbide Corporation;

an alkylarylpolysiloxane, the alkyl preferably being of up to 20 carbon atoms and the aryl of from 6 to 10 carbon atoms, such as methylphenylpolysiloxane; examples are DOW CORNING 550 fluid and DOW CORNING 555 fluid, both available commercially from Dow Corning Corp.; or an amino-functional dimethylpolysiloxane, for example, as in the product designated DOW CORNING fluid or the product designated DOW CORNING 531 fluid, both of which are available commercially from Dow Corning Corp.

Other commercially available polysiloxane-containing products are SAG10 (from Union Carbide Corp.) and SWS-211 (from SWS Silicone Corp.).

In an alternative, and also preferred, embodiment, the composition, concentrate and fountain solution of this invention also contain a preservative agent to inhibit the growth of algae and/or fungus mold. Generally, any agent effective in inhibiting the growth of algae and/or fungus mold is suitable for employment in accordance with this invention. In an especially preferred embodiment the preservative is a compound of the formula

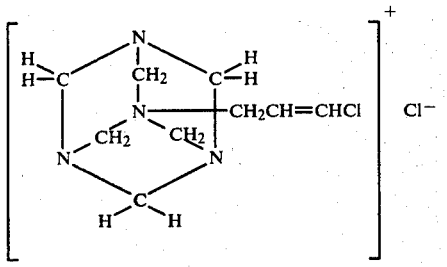

A product containing this compound is available commercially from Dow Chemical Company and designated DOWICIL 75. The product has a bulk density of 43 lbs. per cubic ft. and a specific gravity of 1.54 g. per cubic centimeter. The molecular weight of the compound is 251.2. The perservative is incorporated in the composition, concentrate and fountain solution in an amount effective to inhibit the growth of algae and/or fungus mold, for example, in pans and feed lines of lithographic press apparatus. Such amount is, typically, 0.05 to 0.5% by weight of the composition, preferably 0.05 to 0.3% by weight of the composition, and especially 0.25% by weight of the composition.

In a preferred embodiment of the invention, a composition comprises 18 to 33% by weight tetrapotassium pyrophosphate; 21 to 40% by weight monosodium phosphate; 8 to 12% by weight of a sequestrant; 3 to 5% by weight of a water-soluble polyethylene glycol; 2 to 3% by weight sodium carboxymethyl cellulose; 2.8 to 5% by weight of the low- or non-foaming nonionic detergent; 0.5 to 3% by weight of the anionic detergent; and 0.35 to 1.4% by weight dialkylpolysiloxane. A composition falling within this preferred embodiment is advantageously employed in the formulation of a preferred concentrate and fountain solution, both comprising the composition and water.

In an especially preferred embodiment of the invention, a composition comprises about 32.9% by weight tetrapotassium pyrophosphate; about 38.6% by weight monosodium phosphate; about 11.3% by weight of a sequestrant; about 5% by weight of a water-soluble polyelthylene glycol; about 3% by weight sodium carboxymethyl cellulose; about 3.8% by weight of the nonionic detergent; about 0.5% by weight of the anionic detergent; about 1.2% by weight dimethylpolysiloxane and about 0.25% by weight of a preservative agent of the formula

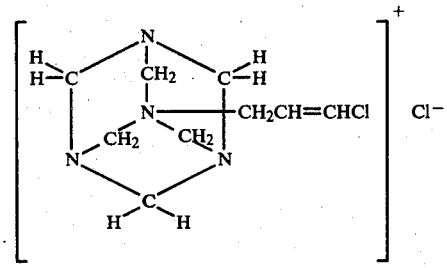

the balance of the composition largely constituting water.

A fountain solution in accordance with this invention is suitably obtainable by combination, for example, admixing, of a composition of the invention with an appropriate amount of water. Thus, in one embodiment, the composition, preferably in the form of a dry powder, is combined with water, in an amount such that the ratio of composition to water yields a neutral (pH), press-ready fountain solution well-suited for commercial web and sheet-fed presses.

The concentrate of this invention comprises a composition of the invention and a lesser amount of water than necessary to formulate a fountain solution. Combination of the composition and water is effected by any convenient technique, for instance, admixing. Such concentrate, in some instances, is useful for purposes for shipping and/or storage, and also provides a convenient precursor which is readily diluted with further water to provide a "press-ready" fountain solution. Typically, the concentrate comprises a combination of the composition of the invention and water in amounts such that the composition and water are present in a ratio of about 27 pounds of said composition to 55 gallons of water. The concentrate is, illustratively, formulated by admixing 27 pounds of a composition and 55 gallons of water until the composition is completely dissolved.

The invention is further illustrated by the following examples. Parts are by weight, unless otherwise specified.

EXAMPLE 1

98.5 pounds of anhydrous tetrapotassium pyrophosphate, 116 pounds of anhydrous monosodium phosphate, 33.75 pounds of Vesene 220 (containing EDTA-$Na_4$), 15 pounds of Carbowax 3350, and 9 pounds of Methocel 4000 were combined by admixing in a paddle blender. 2752 ml. of SM 2162 and 2668 ml. of AF-75 (both containing dimethylpolysiloxane), 5284 ml. of Triton CF-32 and 1000 ml. of Triton H-55 (both commercially available from Rohm & Haas Company) (all liquids) were combined and then 250 g. of DOWICIL 75 and 70 g. of Pylaklor Acid Red LX6515 (a red dye included for aesthetic purposes) were added to the liquid mixture. The resulting liquid was introduced into a pressure tank from which it was sprayed on the powder as it was mixed, until substantially all of the liquid was sprayed on and mixed with the initially-combined constituents.

A batch of composition was thus obtained which is suitable for mixture with water to form either a concentrate or a fountain solution (depending on the amount of water).

EXAMPLE 2

27 pounds of a composition formed as described in Example 1 were introduced into 55 gallons of water and mixed until dissolved. Approximately 55 gallons of a working concentrate of the composition of Example 1 in water were obtained. This concentrate was diluted with water in a ratio of 1.5 ounces of concentrate to 1 gallon of water to obtain a press-ready fountain solution.

From the foregoing, it is seen that the invention provides a composition which is conveniently formulated from readily available materials and which is easily and economically stored and shipped. The composition is, furthermore, well-suited for dilution with water to form a concentrate, which is also well-suited to dilution with water to form a press-ready fountain solution. Alternatively, the composition itself may be diluted with an appropriately larger amount of water to provide such fountain solution. This fountain solution is highly advantageous in that it is neutral in pH, does not contain bichromates and enables efficient and economical performance of a lithographic printing operation without press shutdown and image deterioration attendant to use of prior fountain solutions.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

What is claimed is:

1. A composition suitable for production of a substantially neutral fountain solution, which consists essentially of 15 to 40% by weight tetrapotassium pyrophosphate; 15 to 40% by weight monosodium phosphate; 1 to 15% by weight of a sequestrant; 0.5 to 6% by weight of a water-soluble polyethylene glycol; 0.5 to 4% by weight sodium carboxymethyl cellulose; 2 to 6% by weight of a low- or non-foaming nonionic detergent; 0.5 to 5% by weight of an anionic detergent which is selected from the group consisting of alkyl orthophosphates and salts thereof, alkyl polyphosphates and salts thereof, and mixtures of the foregoing; and 0.15 to 2.7% of a polysiloxane.

2. A composition as defined in claim 1, wherein the tetrapotassium pyrophosphate and monosodium phosphate are anhydrous.

3. A composition as defined in claim 1, which is in the form of a dry powder.

4. A composition as defined in claim 1, wherein the nonionic detergent is selected from the group consisting of ethoxylated alkylphenols, the alkyl of which is from 8 to 12 carbon atoms and in which the polyoxyethylene moiety is of from about 50 to 75% of the total molecular weight, ethoxylated aliphatic alcohols, the alkyl of which is up to 20 carbon atoms and the mole ratio of hydrophobe to combined ethylene oxide in which is of from 1:1 to 1:150, lower-alkoxylated fatty acids, ethoxylated propylene oxide-propylene glycol condensates, and mixtures of the foregoing.

5. A composition as defined in claim 1, which further contains a preservative agent.

6. A composition suitable for production of a substantially neutral fountain solution, which consists essentially of 18 to 33% by weight tetrapotassium pyrophosphate; 21 to 40% by weight monosodium phosphate; 8 to 12% by weight of a sequestrant; 3 to 5% by weight of a water-soluble polyethylene glycol; 2 to 3% by weight sodium carboxymethyl cellulose; 2.8 to 5% by weight of a low- or non-foaming nonionic detergent; 0.5 to 3% by weight of an anionic detergent which is selected from the group consisting of alkyl orthophosphates and salts thereof, alkyl polyphosphates and salts thereof, and mixtures of the foregoing; and 0.3 to 1.4% by weight of a polysiloxane.

7. A composition suitable for production of a substantially neutral fountain solution, which consists essentially of about 32.9% by weight tetrapotassium pyrophosphate; about 38.6% by weight monosodium phosphate; about 11.3% by weight of a sequestrant; about 5% by weight of a water-soluble polyethylene glycol; about 3% by weight sodium carboxymethyl cellulose; about 3.8 % by weight of a low- or non-foaming nonionic detergent; about 0.5% by weight of an anionic detergent which is selected from the group consisting of alkyl orthophosphates and salts thereof, alkyl polyphosphates and salts thereof, and mixtures of the foregoing; and about 1.2% by weight of a polysiloxane.

8. A concentrate suitable for production of a substantially neutral fountain solution, which consists essentially of water and a composition consisting essentially of 15 to 40% by weight tetrapotassium pyrophosphate; 15 to 40% by weight monosodium phosphate; 1 to 15% by weight of a sequestrant; 0.5 to 6% by weight of a water-soluble polyethylene glycol; 0.5 to 4% by weight sodium carboxymethyl cellulose; 2 to 6% by weight of a low- or non-foaming nonionic detergent; 0.5 to 5% by weight of an anionic detergent which is selected from the group consisting of alkyl orthophosphates and salts thereof, alkyl polyphosphates and salts thereof, and mixtures of the foregoing; and 0.15 to 2.7% by weight of a polysiloxane.

9. A substantially neutral fountain solution, which consists essentially of water and a composition consisting essentially of 15 to 40% by weight tetrapotassium pyrophosphate; 15 to 40% by weight monosodium phosphate; 1 to 15% by weight of a sequestrant; 0.5 to 6% by weight of a water-soluble polyethylene glycol; 0.5 to 4% by weight sodium carboxymethyl cellulose; 2 to 6% by weight of a low- or non-foaming nonionic detergent; 0.5 to 5% by weight of an anionic detergent which is selected from the group consisting of alkyl orthophosphates and salts thereof, alkyl polyphosphates and salts thereof, and mixtures of the foregoing; and 0.15 to 2.7% by weight of a polysiloxane.

10. A composition suitable for production of a substantially neutral fountain solution, which consists essentially of 15 to 40% by weight tetrapotassium pyrophosphate; 15 to 40% by weight monosodium phosphate; 1 to 15% by weight of a sequestrant; 0.5 to 6% by weight of a water-soluble polyethylene glycol; 0.5 to 4% by weight sodium carboxymethyl cellulose; 2 to 6% by weight of a low-or non-foaming nonionic detergent selected from the group consisting of ethoxylated alkylphenols, the alkyl of which is from 8 to 12 carbon atoms and in which the polyoxyethylene moiety is of from about 50 to 75% of the total molecular weight, ethoxylated aliphatic alcohols, the alkyl of which is up to 20 carbon atoms and the mole ratio of hydrophobe to combined ethylene oxide in which is of from 1:1 to 1:150, lower-alkoxylated fatty acids, ethoxylated propylene oxide-propylene glycol condensates, and mixtures of the foregoing; 0.5 to 5% by weight of an anionic detergent selected from the group consisting of reaction products of a molar excess of polyphosphoric acid and a nonionic detergent selected from a group consisting of compounds of the formula

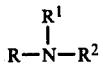

wherein R is $C_8H_{17}$ to $C_{14}H_{29}$, $R^1$ is $(—CH_2—CH_2O)_xH$ and $R^2$ is hydrogen, $C_8H_{17}$ or $(—CH_2—CH_2O)_yH$, x being a number in the range of from 5 to 50 and y being a number in the range of from 5 to 50, provided that the sum of x and y is a number in the range of from 5 to 50; of the formula

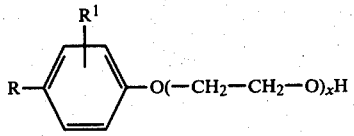

wherein R is hydrogen or alkyl of from 1 to 12 carbon atoms, $R^1$ is hydrogn or alkyl of from 1 to 9 carbon atoms and x is at least 1 and preferably no more than 3;

and of the formula $$R—O—(CH_2—CH_2—O)_xH$$

wherein R is $C_{12}H_{23}$ or $C_8H_{17}$—$C_{18}H_{37}$ and x is at least 1 obtained by condensing a polyglycol ether containing the requisite number of alkenoxy groups or an alkylene oxide with an organic compound containing a reactive hydrogen atom, salts of said reaction products and mixtures of the foregoing, and 0.15 to 2.7% by weight of a polysiloxane selected from the group consisting of dialkylpolysiloxanes, polyoxyalkylene-modified dimethylpolysiloxanes, alkylarylpolysiloxanes and amino-functional dimethylpolysiloxanes.

11. A concentrate suitable for production of a substantially neutral fountain solution, which consists essentially of water and a composition as defined in claim 10.

12. A substantially neutral fountain solution, which consists essentially of water and a composition as defined in claim 10.

13. A composition suitable for production of a substantially neutral fountain solution, which consists essentially of 15 to 40% by weight tetrapotassium pyrophosphate; 15 to 40% by weight monosodium phosphate; 1 to 15% by weight of a sequestrant; 0.5 to 6% by weight of a water-soluble polyethylene glycol; 0.5 to 4% by weight sodium carboxymethyl cellulose; 2 to 6% by weight of a low- or non-foaming nonionic detergent selected from the group consisting of ethoxylated alkylphenols, the alkyl of which is from 8 to 12 carbon atoms and in which the polyoxyethylene moiety is of from about 50 to 75% of the total molecular weight, ethoxylated aliphatic alcohols, the alkyl of which is up to 20 carbon atoms and the mole ratio of hydrophobe to combined ethylene oxide in which is of from 1:1 to 1:150, lower-alkoxylated fatty acids, ethoxylated propylene oxide-propylene glycol condensates, and mixtures of the foregoing; 0.5 to 5% by weight of an anionic detergent selected from the group consisting of reaction products of $P_2O_5$, alkaline reacting inorganic alkali metal substances and nonionic surface active agents, each of which agents is a condensation product of at least one mole of ethylene oxide, and up to an amount sufficient to provide said agent with about 95% by weight of combined ethylene oxide, with one mole of a compound containing about 6 to about 150 carbon atoms and at least one reactive hydrogen atom, said reaction products being obtained by reaction in a ratio of one mole of $P_2O_5$ for each 2 to 4.5 hydroxy groups in said nonionic agent, and reaction with such phosphorylated agent of an amount of an alkaline reacting inorganic alkali metal substance sufficient to yield with said phosphorylated agent an aqueous solution having a pH of more than about 12 when the combined concentration of said phosphorylated agent and said alkali metal substance in the solution is about 0.3% by weight; and 0.15 to 2.7% by weight of a polysiloxane selected from the group consisting of dialkylpolysiloxanes, polyoxyalkylene-modified dimethylpolysiloxanes, alkylarylpolysiloxanes and amino-functional dimethylpolysiloxanes.

14. A concentrate suitable for production of a substantially neutral fountain solution, which consists essentially of water and a composition as defined in claim 13.

15. A substantially neutral fountain solution, which consists essentially of water and a composition as defined in claim 13.

16. A composition suitable for production of a substantially neutral fountain solution, which consists essentially of 15 to 40% by weight tetrapotassium pyrophoshpate; 15 to 40% by weight monosodium phosphate; 1 to 15% by weight of a sequestrant; 0.5 to 6% by weight of a water-soluble polyethylene glycol; 0.5 to 4% by weight sodium carboxymethyl cellulose; 2 to 6% by weight of a low- or non-foaming nonionic detergent selected from the group consisting of ethoxylated alkylphenols, the alkyl of which is from 8 to 12 carbon atoms and in which the polyoxyethylene moiety is of from about 50 to 75% of the total molecular weight, ethoxylated aliphatic alcohols, the alkyl of which is up to 20 carbon atoms and the mole ratio of hydrophobe to combined ethylene oxide in which is of from 1:1 to 1:150, lower-alkoxylated fatty acids, ethoxylated propylene oxide-propylene glycol condensates, and mixtures of the foregoing; 0.5 to 5% by weight of an anionic detergent selected from the group consisting of reaction products of mono- and diphosphate esters and mixtures thereof obtained by reacting 1 mole of $P_2O_5$ with 2 to 4.5 moles of hydroxylic organic compounds containing at least 6 carbon atoms and a reactive hydrogen atom under substantially anhydrous conditions and then hydrolyzing the phosphate ester with at least about 0.15% by weight of water at a temperature below the decomposition temperature of the phosphate ester, salts of said esters and mixtures of the foregoing; and 0.15 to 2.7% by weight of a polysiloxane selected from the group consisting of dialkylpolysiloxanes, polyoxyalkylene-modified dimethylpolysiloxanes, alkylarylpolysiloxanes and amino-functional dimethylpolysiloxanes.

17. A concentrate suitable for production of a substantially neutral fountain solution, which consists essentially of water and a composition as defined in claim 16.

18. A substantially neutral fountain solution, which consists essentially of water and a composition as defined in claim 16.

* * * * *